United States Patent [19]

Ho

[11] Patent Number: 5,010,734

[45] Date of Patent: Apr. 30, 1991

[54] COOLING SYSTEM FOR A STIRLING ENGINE

[75] Inventor: Kwang S. Ho, Seoul, Rep. of Korea

[73] Assignee: Goldstar Co., Ltd., Seoul, Rep. of Korea

[21] Appl. No.: 570,729

[22] Filed: Aug. 22, 1990

[30] Foreign Application Priority Data

Aug. 31, 1989 [KR] Rep. of Korea ..... 12573/1989

[51] Int. Cl.[5] ..... F02G 1/055

[52] U.S. Cl. ..... 60/517

[58] Field of Search ..... 60/517, 524

[56] References Cited

U.S. PATENT DOCUMENTS 4,662,176 5/1987 Fijiwara et al. ..... 60/517 X

*Primary Examiner*—Allen M. Ostrager

*Attorney, Agent, or Firm*—Birch, Stewart, Kolasch & Birch

[57] ABSTRACT

A cooling system for a Stirling engine which includes a cooler, an ultrasonic wave generator for making cooling fluid into atomized particles, a water tank, a pump and an electric power generator for generating electric power by driving force of the Stirling engine to supply the electric power to the pump and the ultrasonic wave generator, whereby the cooling fluid is converted to atomized particles of cooling fluid and then phase changing latent heat generated by the process of changing the atomized particles of cooling fluid to gas is utilized so that working fluid of Stirling engine is effectively cooled.

3 Claims, 2 Drawing Sheets

COOLING SYSTEM FOR A STIRLING ENGINE

BACKGROUND OF THE INVENTION

1. Field of the Invention

The present invention relates to a cooling system for a Stirling engine and more particularly, to a cooling system for a Stirling engine in which cooling fluid is atomized particles and then phase changing latent heat generated by the process of changing the atomized particles of cooling fluid to gas is utilized to the Stirling engine so that working fluid of the Stirling engine is effectively cooled.

2. Description of the Prior Art

The Stirling engine utilizes a principle that the pressure is raised when the working fluid is heated in the Stirling engine while the pressure is dropped when the working fluid is cooled. Accordingly, when a predetermined amount of the working fluid is heated in a heating chamber, the pressure is raised, whereby a power piston inserted in a cylinder is dropped downward. And while the working fluid is cooled, the pressure is dropped, whereby the power piston is lifted upward and the motion of the power piston is repeated so that the power is obtained.

A kind of conventional Stirling engines comprises a cooling system for cooling the working fluid as shown in FIG. 2, which includes a cooler 12 attached to a Stirling engine 11, a pump 13 connected to the cooler 12, and a water tank 14. When the water stored in the water tank 14 is pumped to the cooler 12 by the pump 13, the water circulates around the Stirling engine 11 and the circulated water returns to the cooler 12 and upon cooling the water, the cooled water comes back to the water tank 14 to be flowed to the Stirling engine 11 through the cooler 12. Thus the cooling water repeats to circulate around the Stirling engine 11, whereby the working fluid of the stirling engine 11 is cooled.

As shown in FIG. 2, reference numeral 15 represents a cylinder, 16 is an expansion space, 17 is a compression space, 18 is a power piston, 19 is a displacer, and 20 represents a wheel, respectively.

Another conventional cooling system, namely an air cooling system for a Stirling engine, utilizes cooling air for cooling by circulating around the Stirling engine 11 with the cooling air.

However, as aforementioned, the case of water cooling system for cooling by circulating directly the cooling fluid around the Stirling engine 11 not only requires large amount of cooling water but also cooling efficiency is reduced and in the case of air cooling system also, there are a lot of disadvantages such as problem for the cooling efficiency as similar as in the water cooling system.

SUMMARY OF THE INVENTION

Accordingly, it is an object of the present invention to provide an improved cooling system for a Stirling engine.

Another object of the present invention is to provide a cooling system for a Stirling engine in which cooling fluid is made into liquid drops such as fine particles of cooling fluid by an ultrasonic wave generator and thereafter, working fluid of the Stirling engine is cooled by the latent heat evaporation when the liquid drops of cooling fluid is changed to gas so that cooling efficiency can be improved.

A further object of the present invention is to provide a cooling system for a Stirling engine comprises a cooler attached to a Stirling engine, an ultrasonic wave generator for making water into atomized water particles, a water tank for feeding cooling water to the ultrasonic wave generator, and a pump for pumping the atomized water particles generated by the ultrasonic waver generator to the cooler.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a cooling system for a Stirling engine, which includes a cooler, an ultrasonic wave generator for making cooling fluid into atomized particles of cooling fluid, a water tank, a pump, and a electric power generator for generating electric power by driving force of the Stirling engine to supply the electric power to the pump and the ultrasonic wave generator, whereby the cooling fluid is converted to atomized particles of cooling fluid and then phase changing latent heat generated by the process of changing the atomized particles of cooling fluid to gas is utilized so that working fluid of Stirling engine is effectively cooled.

BRIEF DESCRIPTION OF THE DRAWINGS

The present invention will become more fully understood from the detailed description given hereinbelow and the accompanying drawing which are given by way of illustration only, and thus are not limitative of the present invention, and wherein.

DESCRIPTION OF THE PREFERRED EMBODIMENTS

Figure 1:
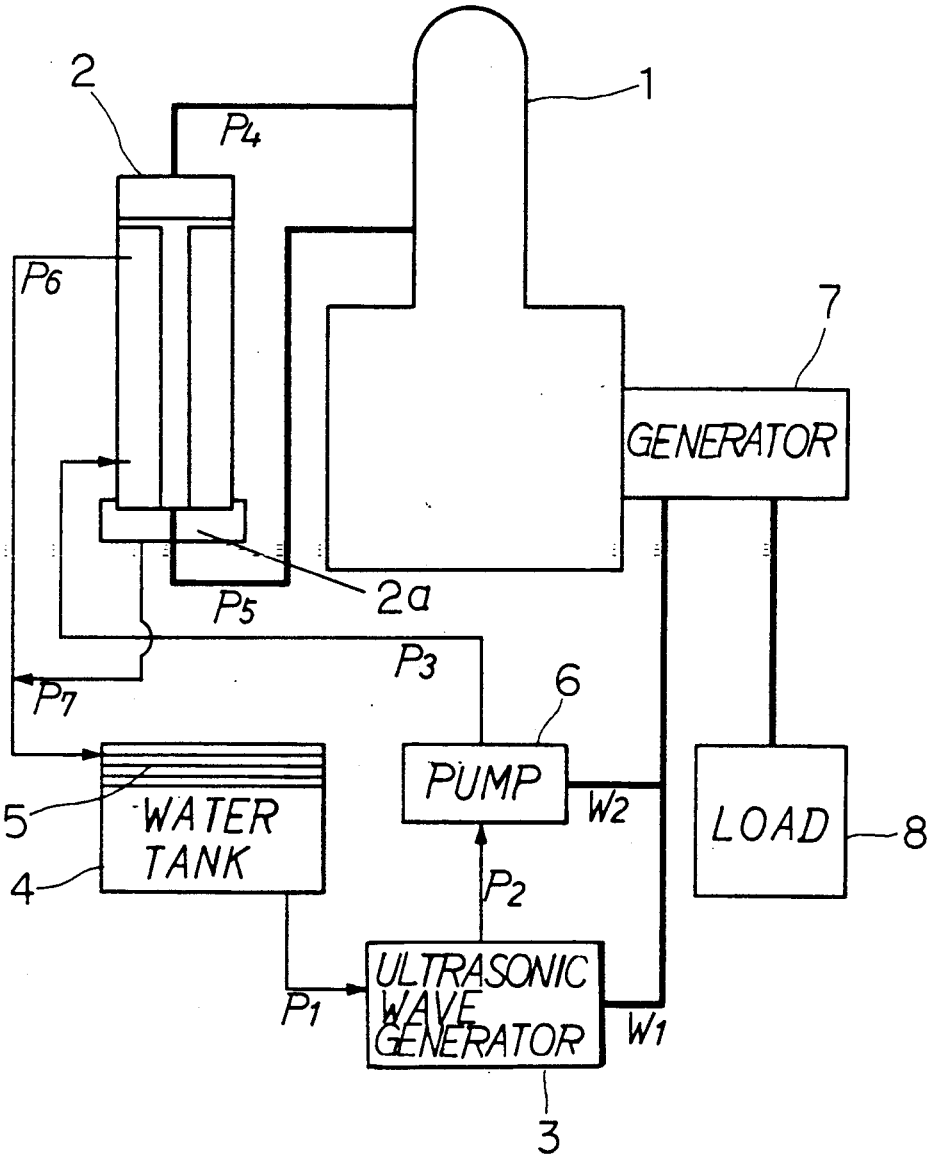
FIG. 1 is a schematic diagram of the cooling system for a Stirling engine according to the present invention.
Figure 2:
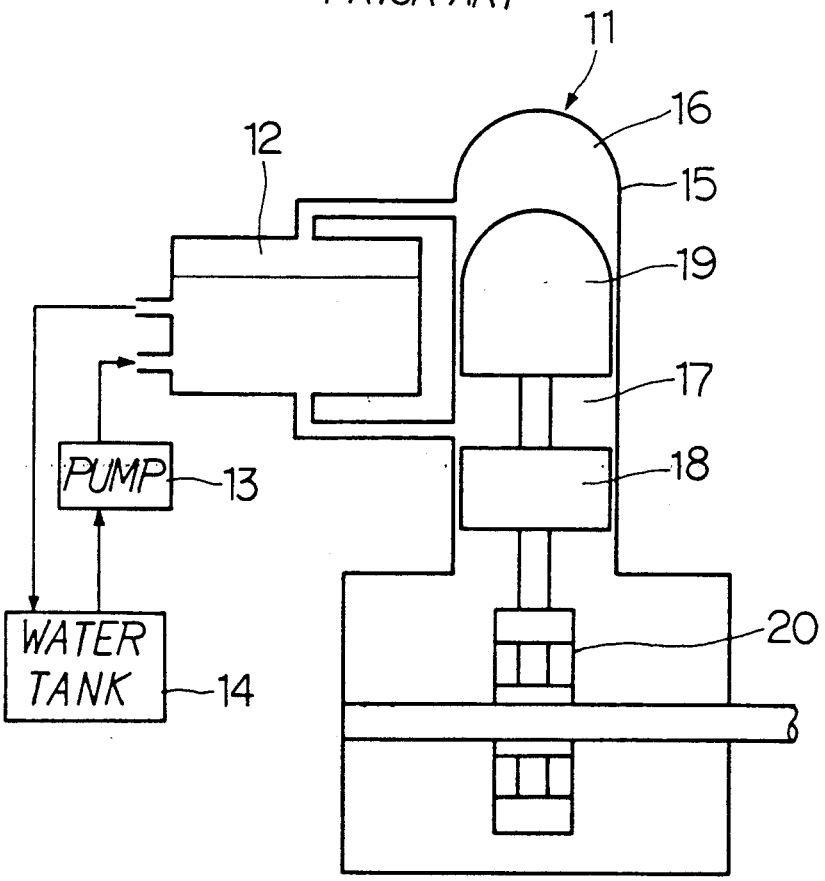
FIG. 2 PRIOR ART
FIG. 2 is a schematic diagram of a conventional cooling system for a Stirling engine.

Referring now in detail to the drawings for the purpose of illustrating preferred embodiments of the present invention, the cooling system for a Stirling engine as shown in FIG. 1, comprises a cooler 2 attached to a Stirling engine 1, an ultrasonic wave generator 3 for making cooling fluid such as water into atomized particles of the cooling fluid, a liquid tank 4 for feeding cooling fluid to the ultrasonic wave generator 3, a pump 6 for pumping the liquid drops of cooling fluid generated by the ultrasonic wave generator 3 to the cooler 2 of the Stirling engine 1, and electric power supply means for feeding electric power to the pump 6.

The liquid tank 4 and the ultrasonic wave generator 3 are connected to each other through a first pipe Pl so that liquid such as water stored in the liquid tank 4 is flowed into the ultrasonic wave generator 3. The ultrasonic wave generator 3 and the pump 6 are connected to each other through a second pipe P2, the pump 6 and the cooler 2 are connected to each other through a third pipe P3, and the cooler 2 and the Stirling engine 1 are connected to each other through a fourth pipe P4 and a fifth pipe P5, respectively, whereby the atomized particles of cooling fluid generated by the ultrasonic wave generator 3 are pumped to the cooler 2 and then the atomized particles of cooling fluid are forcibly circulated from the cooler 2 to the Stirling engine 1 and at that time, the atomized particles of cooling fluid are evaporated so that the working fluid of the Stirling engine 1 is cooled (FIG. 1).

Furthermore, upper and lower portions of the cooler 2, and upper portion of the liquid tank 4 are connected to each other through sixth and seventh pipes P6 and P7 so that the water of gas phase having finished cooling operation comes back from the cooler 2 to the liquid tank 4. A radiator 5 is provided to the upper portion of the liquid tank 4 for converting the liquid such as water of gas phase.

The electric power supply means includes an electric power generator 7 mounted to a side of Stirling engine 1, whereby the power generator 7 is operated by the power of Stirling engine 1. The electric power generator 7 is connected to the ultrasonic wave generator 3 and the sixth pump 6 by first and second electric power supply wires W1 and W2. In the drawing, reference numeral 8 represents a load.

The cooling system for a Stirling engine according to the present invention operates as follows:

Water is flowed from the liquid tank 4 to the ultrasonic wave generator 3 and thereafter, the cooling fluid such as water is made to atomized particles by the ultrasonic vibration operation of the ultrasonic wave generator 3. Thereafter, the produced atomized particles of water are flowed into the cooler 2 by the pumping operation of the sixth pump 6, whereby the atomized particles of, cooling fluid, water, are circulated around the Stirling engine 1 and in the process of circulating, while the atomized particles of water are converted to gas phase, whereby the latent heat of evaporation is produced, the working fluid of the Stirling engine 1 is cooled.

Thus, the working fluid of the Stirling engine 1 is cooled and then the cooling fluid such as water of gas phase is flowed from the cooler 2 through the sixth pipe P6 to the upper portion of the liquid tank 4. While upon passing through the radiator 5 mounted to the upper portion of the liquid tank 4, the gas of gas phase is converted again to the cooling fluid such as water of liquid phase and the cooling fluid, water, of liquid phase is collected to a liquid reservoir 2*a* of bottom portion of the cooler 2. Thereafter, the liquid is flowed through the seventh pipe P7 to the liquid tank 4, and liquid thus flowed into the liquid tank 4 is fed back again to the ultrasonic wave generator 3 so that the cooling operation as aforementioned is continuously repeated.

Furthermore, during operating the Stirling engine 1, since the electric power generator 7 generates the electric power by utilizing the driving force outputted from the Stirling engine 1. Thus the generated electric power is supplied to the ultrasonic wave generator 3 and the pump 6, the ultrasonic wave generator 3 and the pump 6 are driven together by the driving force of the Stirling engine and consequently, such cooling cycle is continuously executed without separate electric power supply means.

According to the present invention described as above, the cooling liquid fed from the liquid tank 4 is fed t the ultrasonic wave generator 3, whereby the liquid is converted to the atomized particles of the liquid by the ultrasonic vibration of the ultrasonic wave generator 3. Thereafter, the liquid of atomized state is circulated to the cooler 2 of the Stirling engine 1 by the pumping operation of the pump 6 and evaporated, whereby the latent heat of evaporation is produced in maximum so that the working fluid of the Stirling engine 1 is cooled by the latent heat of evaporation. Therefore, there are many advantages such as the cooling effect is further more excellent than the existing water-cooled or air-cooled type cooling system.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A cooling system for a Stirling engine with working fluid, which comprises:
   - a cooler attached to said Stirling engine,
   - an ultrasonic wave generator for making liquid into atomized particles of liquid,
   - a liquid tank for feeding liquid to said ultrasonic wave generator, and
   - a pump for pumping said atomized particles of liquid produced from said ultrasonic wave generator so as to circulate to said cooler attached to the Stirling engine, whereby working fluid of the Stirling engine is effectively cooled.

2. The cooling system of claim 1, wherein an electric power generator is operatively coupled to said Stirling engine for supplying the electric power to said pump and said ultrasonic wave generator by generating with the driving force of said Stirling engine.

3. The cooling system of claim 1, wherein the liquid is water.

* * * * *